US009986816B2

(12) United States Patent
Kumpf

(10) Patent No.: US 9,986,816 B2
(45) Date of Patent: Jun. 5, 2018

(54) METHOD FOR MANUFACTURING BRISTLE ARRANGEMENTS, AND DEVICE FOR MANUFACTURING BRISTLE ARRANGEMENTS

(71) Applicant: Zahoransky AG, Todtnau (DE)

(72) Inventor: Ingo Kumpf, Todtnau (DE)

(73) Assignee: Zahoransky AG, Todtnau (DE)

( * ) Notice: Subject to any disclaimer, the term of this patent is extended or adjusted under 35 U.S.C. 154(b) by 249 days.

(21) Appl. No.: 14/796,222

(22) Filed: Jul. 10, 2015

(65) Prior Publication Data

US 2016/0015162 A1 Jan. 21, 2016

(30) Foreign Application Priority Data

Jul. 15, 2014 (DE) ..... 10 2014 010 630

(51) Int. Cl.

| | |
|---|---|
| ***A46B 9/02*** | (2006.01) |
| ***A46D 3/08*** | (2006.01) |
| ***A46D 3/04*** | (2006.01) |
| ***A46D 1/08*** | (2006.01) |

(52) U.S. Cl.

CPC ..... *A46B 9/02* (2013.01); *A46D 1/08* (2013.01); *A46D 3/04* (2013.01); *A46D 3/047* (2013.01); *A46D 3/08* (2013.01)

(58) Field of Classification Search

CPC . A46B 9/02; A46D 3/047; A46D 3/00; A46D 3/06; A46D 3/005; A46D 3/04; A46D 3/045; A46D 1/08; A46D 3/082

See application file for complete search history.

(56) References Cited

U.S. PATENT DOCUMENTS

| | | | | |
|---|---|---|---|---|
| 4,609,228 | A * | 9/1986 | Bickel | A46B 3/06 264/243 |
| 8,814,275 | B2 * | 8/2014 | Rees | A46D 3/04 300/21 |
| 2013/0005158 | A1 * | 1/2013 | Richardson | H02K 11/40 439/27 |
| 2016/0157599 | A1 * | 6/2016 | Kumpf | A46D 3/08 300/4 |

FOREIGN PATENT DOCUMENTS

| | | |
|---|---|---|
| DE | 102013003249 | 8/2014 |
| DE | 102014109320 | 1/2015 |
| EP | 0149996 | 7/1985 |

* cited by examiner

*Primary Examiner* — Shay Karls
(74) *Attorney, Agent, or Firm* — Volpe and Koenig, P.C.

(57) ABSTRACT

A method and device for manufacturing bristle arrangements for brushes. The brush is populated with a carrier pad, and to enable simplification of the manufacture of bristle arrangements for brushes, the bristle bundles which are conveyed by a gas or air stream through the conveying device to the bundle-retaining plate, when being conveyed through the conveying device are electrostatically discharged, such that they are more easily conveyed through the conveying device, and in that they reduce the complexity in the fastening of bristle bundles in a carrier pad without anchoring, since the carrier pad on the rear side has material protrusions which are fused and thereafter interference-fitted in a bundle-fastening plane, in order for bristle bundles which have been incorporated into the perforations of the carrier pad to be connected in a form-fitting and/or force-fitting manner to the carrier pad in a simple manner.

24 Claims, 2 Drawing Sheets

METHOD FOR MANUFACTURING BRISTLE ARRANGEMENTS, AND DEVICE FOR MANUFACTURING BRISTLE ARRANGEMENTS

INCORPORATION BY REFERENCE

The following documents are incorporated herein by reference as if fully set forth: German Patent Application No. 10 2014 010 630.6, filed Jul. 15, 2014.

BACKGROUND

The invention relates to a method for manufacturing bristle arrangements for brushes, in particular for toothbrushes, wherein bristle filaments are removed from a material box which contains a reserve of bristle filaments and are assembled to form bristle bundles, and then are directed by a gas or air stream through a conveying device comprising a bundle-receiving device and hollow conduits which are connected thereto, and subsequently are incorporated through perforations into a bundle-retaining plate.

The present invention moreover also relates to a device for manufacturing bristle arrangements for brushes, in particular toothbrushes, having a material box containing a reserve of bristle filaments, and having at least one removal device for removing individual bristle bundles from the bristle reserve, and having a conveying device with hollow conduits, through which hollow conduits the bristle bundles are conveyable by a gas or air stream into perforations of a bundle-retaining plate.

Methods and devices as described above for manufacturing bristle arrangements are known in various forms.

A method of the type defined at the outset is known from EP 149 996 A2, for example.

In the methods and devices for manufacturing bristle arrangements which are known from the prior art issues may arise in the in-feeding of bristle bundles which are comprised of individual bristles through a conveying device by a gas or air stream in the in-feeding of the bristle filaments to the portions or stations of the device which are downstream of the conveying device.

It may thus arise that individual bristle filaments or else entire bristle bundles remain stuck in the conveying device and do not reach their destination. Above all in the case of the bristle filaments being particularly fine bristle filaments, reliable in-feeding of the bristle filaments through the conveying device may be particularly difficult.

SUMMARY

It is thus an object of the invention to provide a method for manufacturing bristle arrangements and a device for manufacturing bristle arrangements as defined at the outset which allow more efficient and simpler manufacturing of bristle arrangements and thus more efficient and simpler manufacturing of brushes, in particular of toothbrushes.

The object is achieved in the method defined at the outset by including one or more features of the invention, and in particular in that the bristle filaments forming the bristle bundles when being conveyed through the conveying device to the bundle-retaining plate are electrostatically discharged.

In particular when in-feeding so-called chemically tapered bristle filaments which are distinguished by their particularly fine filament counts, clogging of the conveying device may repeatedly arise in the case of the methods which are known from the prior art, the reason for which has been identified to be electrostatic charging of the bristle filaments which form the bristle bundles. Regardless of whether by way of the gas or air stream or by way of the material of the hollow conduits through which the bristle bundles are conveyed, due to the frictional effects which act on the bristle filaments of the bristle bundles when being conveyed through the conveying device, the bristle bundles and the bristle filaments contained in the bristle bundles may be electrostatically charged, such that they adhere to the elements of the conveying device, in particular on the hollow conduits of the conveying device, and cannot not be reliably guided through the conveying device. Moreover, there is even the risk that the bristle filaments when being conveyed through the conveying device are so severely electrostatically charged that they clog the conveying device and the passage of the bristle filaments to the bundle-retaining plate is at best restricted.

Due to electrostatically discharging the bristle filaments when being conveyed, these disadvantages may be avoided. Finally, a method may be provided by way of which even particularly fine bristle filaments, namely such which are chemically tapered, are in-fed in a particularly efficient manner by a gas or air stream to a bundle-retaining plate for further processing.

In order for the bristle bundles to be reliably discharged it may be particularly expedient for the bristle filaments forming the bristle bundles to be electrostatically discharged when being conveyed through the bundle-receiving device of the conveying device and/or when being conveyed through hollow conduits of the conveying device to the bundle-retaining plate.

In particular in the event of electrostatically discharging the bristle filaments when being conveyed through the bundle-receiving device, electrostatic charging of the bristle filaments may already be avoided when conveying through the conveying device commences.

Alternative or additional electrostatic discharging of the bristle filaments when being conveyed through the hollow conduits of the conveying device to the bundle-retaining plate may prevent the bristle filaments being statically charged by friction on the inner sides of the hollow conduits and then clogging the hollow conduits.

Particularly simple but no less reliable electrostatic discharging of the bristle filaments is possible when the bristle filaments forming the bristle bundles are grounded for electrostatic discharging when being conveyed through the conveying device, in particular when being conveyed through the bundle-receiving device and/or through the hollow conduits, to the bundle-retaining plate.

To this end, the bristle bundles when being conveyed through the conveying device, in particular when being conveyed through the bundle-receiving device and/or through the hollow ducts, to the bundle-retaining plate, may be guided past at least one electrical terminal or ground terminal which is disposed on the conveying device, and be made to establish contact therewith. It should be pointed out that this at least one electric terminal or ground terminal may be provided in the bundle-receiving device and/or also in the hollow conduits, for example.

In this manner, particularly simple yet reliable electrostatic discharging of the bristle filaments forming the bristle bundle may be achieved. It should be pointed out at this juncture that electrostatically discharging the bristle filaments forming the bristle bundles when being conveyed through the conveying device not only enables dissipation of electrostatic charges which adhere to the bristle filaments but also renders avoidable electrostatic charging of the bristle filaments in particular caused by friction which arises when the bristle filaments forming the bristle bundles are being conveyed through the conveying device.

In one embodiment of the method it may be provided that the bristle bundles from the bundle-retaining plate are directly incorporated into perforations of a carrier pad. However, in one particularly advantageous embodiment of the method it may be provided that the bristle bundles in particular with the aid of a compression die are incorporated through narrowing funnel ducts of a funnel plate into perforations of a carrier pad. This may be meaningful since the degree of compression of the bristle bundles which is required for high-quality population of carrier pads may be achieved only with great complexity by a gas or air stream alone. In that the bristle bundles to be in-fed are initially squeezed through the funnel ducts of the funnel plate, the desired degree of compression may be achieved in a comparatively simple manner, in particular when a compression die is used.

In order for the bristle bundles to be able to be fastened without anchoring in the carrier pad, it may be provided that material protrusions which protrude on the rear side of a back side of the carrier pad which faces away from the bristle bundles are heated in a welding station and are thereby fused, wherein for connecting the bristle bundles to the carrier pad a melt of the fused material protrusions is interference-fitted into a fastening plane of the bristle bundles, such that the melt flows between bristle-bundle ends, which in particular protrude from the back side of the carrier pad, and/or between filament ends of the bristle bundles, and thereafter solidifies. It is thus possible for the bristle bundles to be fastened in a form-fitting and/or force-fitting manner on the carrier pads, since on account of being interference-fitted into the bundle-fastening plane the melt may mesh, so to speak, with the ends of the bristle bundles.

In this way, a particularly simple method for the fastening of bristle bundles in a carrier pad without anchoring may be achieved.

Expediently, here the material protrusions on the carrier pad by a welding die may be heated, fused, and for fastening the bristle bundles to the carrier pad may be interference-fitted into a fastening plane of the bristle bundles.

The advantages of the method described may be utilized in particular when the bundle-retaining plate is in-fed bristle bundles of chemically tapered bristle filaments. These bristle filaments which are also referred to as CTFs are distinguished by their particularly finely tapered filament ends which in the use position are free-standing and which, on account of static charging of the particularly fine bristle filaments in this case, have to date made in-feeding of such bristle filaments by a gas or air stream through a conveying device difficult and thus uneconomical.

In a further design embodiment of the method according to the invention it may be provided that the bristle filaments are in-fed to a transfer station in filament pucks which are held together by an in particular flexible and/or air-impermeable sheathing. The filament pucks which are in-fed to the transfer station may then be acquired by suction by at least one suction gripper which is assigned to the transfer station, wherein the at least one suction gripper contacts and acquires by suction the filament pucks at their free upper side by way of a suction plate on account of which the in particular flexible and/or air-impermeable sheathing is acquired by suction in a transverse manner to the longitudinal axis of the bristle filaments and in an inward manner in the direction of a longitudinal center axis which is oriented so as to be perpendicular to the upper side of the filament puck, and said sheathing may place itself in a stabilizing manner around the bristle filaments of the filament puck which has been acquired by suction. After having been acquired by suction, the filament puck by the at least one suction gripper may be transferred to a de-sheathing station which is downstream of the transfer station. In this de-sheathing station the sheathing of the filament puck may be opened and removed, due to which the bristle filaments which have been released from the sheathing may be in-fed, preferably in an automated manner, to a or to the already mentioned material box.

It should be pointed out at this juncture that the filament pucks of chemically tapered bristle filaments having a flexible and/or air-impermeable sheathing have been previously described in DE 10 2013 003 249, for example, which relates to a manufacturing method of such filament pucks.

The mode of functioning of the de-sheathing station described earlier is described in the German patent application DE 10 2014 109 320, for example.

It may be advantageous for the filament pucks to be provided with a spin finish having an antistatic additive for CFTs which may additionally reduce the tendency of the bristle filaments toward static charging when being conveyed.

In one advantageous refinement of the method described earlier it may moreover be provided that the filament pucks of the transfer station are in-fed in particular to the at least one suction gripper of the transfer station on at least one contact area of an in-feed station which is preferably configured as a conveyor belt.

This may further improve the efficiency and the degree of automation of the method described earlier.

Moreover, the method may be simplified for an operator who is entrusted with carrying out the method when the filament pucks are held ready individually and/or in their supply containers at the in-feed station, in particular at the at least one contact area which is preferably configured as a conveyor belt, and if and when required, are pushed onto the at least one contact area, preferably manually, in particular directly from the supply containers, but in particular in a transverse manner to the conveying direction of the at least one contact area. In this way it is possible for the operator who is entrusted with carrying out the method to prepare a certain number of filament pucks or a certain number of supply containers with filament pucks, respectively, at the contact area of the in-feed station which is configured as a conveyor belt and if and when required, that is to say when the filament pucks which already have been placed onto the contact area of the in-feed station have been consumed by the downstream stations of the device, the former can be indexed for replenishment. Depending on the number of filament pucks which have been placed on the contact area and depending on the processing time, that is to say the time which is required by the downstream stations for processing a filament puck, the operator who is entrusted with carrying out the method may thus have sufficient time for carrying out other tasks and many only need to approach the in-feed station at certain time intervals in order to reload further filament pucks, enabling the otherwise automated manufacturing process to continue without disruption.

In a carrier pad having a plurality of perforations which penetrate the carrier pad, into which perforations the bristle bundles which are comprised of bristle filaments are insertable and fastenable without anchoring on the carrier pad it is provided that the carrier pad on its back side which faces away from the bristle bundles which are guided into the perforations has a plurality of material protrusions, wherein the material protrusions are fusible and for fastening the bristle bundle on the carrier pad are force-fittable in a bundle-fastening plane.

A carrier pad of this type enables simple fastening of bristle bundles without anchoring in the carrier pad, without the bristle bundles to be fastened in the carrier pad having to be welded to one another prior to being in-fed into the carrier pad. The carrier pad according to the invention in a particularly advantageous manner thus supports carrying out the method described earlier.

It may be expedient for the bristle bundle post fusing of the material protrusions and interference-fitting of the fused material protrusions into the bundle-fastening plane to be connected to the carrier pad in a form-fitting and/or force-fitting manner. Reliable fastening of the bristle bundles in or on the carrier pad which is resistant to the required extraction forces may be enabled in this way.

It may be expedient here for the material protrusions to be configured as pimples, wherein the material protrusions may project transversely from the back side of the carrier pad. In this context, transverse means that the material protrusions may project from the back side of the carrier pad so as to substantially be extensions of the bristle bundle which has been plugged into the carrier pad. Expediently, a longitudinal center axis of the material protrusions here will be oriented so as to be perpendicular to the back side of the carrier pad.

It may furthermore be provided that the material protrusions are disposed so as to be in particular uniformly distributed around the perforations of the carrier pad or therebetween. This may facilitate uniform distribution of the melt, in particular post interference-fitting of the melt into the bristle-fastening plane, on the back side of the carrier pad and between the ends of the bristle bundles, and in particular between individual bristle filaments of the bristle bundle, and thus contribute toward reliable fastening of the bristle bundle in the carrier pad.

In order to be able to manufacture bristle arrangements having variable bristle-bundle cross sections, it may be expedient for the perforations on the carrier pad to have variable cross sections. The perforations thus may have a round and/or oval and/or circular and/or polygonal cross section, for example. The combination of perforations of different cross section here is of course possible. Furthermore, it may be provided for the perforations to be configured as elongate perforations.

The carrier pad is particularly simple to manufacture when the material protrusions are integrally connected to the carrier pad and/or when the material protrusions are comprised of the same material as the carrier pad, in particular of a fusible plastic material, preferably of a thermoplastic material. Here, the material of which the material protrusions are comprised may have a lower or else a higher melting point than the material of which the bristle filaments and/or the bristle bundles are comprised. A typical material of which the carrier pad and/or the material protrusions on the back side of the carrier pad may be comprised is the plastic material polypropylene. A typical material of which the bristle bundles or bristle filaments, respectively, may be comprised is polybutylene terephthalate (PBT).

It is advantageous for the material protrusions to narrow, in particular to narrow in a conical manner, toward their free end. If the material protrusions have a narrowing shape, fusing these material protrusions is substantially facilitated when the welding die is pushed in.

It may be advantageous for the carrier pad on it back side which faces away from the bristle bundles to have a delimitation which preferably is endless and closed and projects in particular in a perpendicular manner from the back side of the carrier pad. This delimitation here may surround the perforations and the material protrusions and comprise the back side of the carrier pad. The rear-side delimitation of the carrier pad may prevent the melt of the fused material protrusions laterally oozing out when the welding die is pushed in, and moreover may contribute toward reliable guiding of the fused material protrusions when the melt is interference-fitted into the bundle-fastening plane of the carrier pad.

Lateral oozing of the melt may be prevented in a particularly reliable manner when the delimitation of the carrier pad is at least half the height of the material protrusions which are disposed on the back side of the carrier pad. However, in one particularly advantageous design embodiment of the carrier pad this delimitation may be higher than the material protrusions on the back side of the carrier pad, in particular double the height of said material protrusions. In this way it may be particularly and reliably prevented that the melt of the fused material protrusions is laterally squeezed out when the melt is interference-fitted into the bundle-fastening plane of the carrier pad, in particular by a fusing die.

In a brush, in particular a toothbrush, having a handle and a brush head, wherein the brush head has a carrier-pad receptacle and a carrier pad which is fastened therein and which is populated with bristle bundles it is provided that the carrier pad is a carrier pad as described earlier.

It may be particularly advantageous here for the carrier pad to be clipped into the carrier-pad receptacle. Additionally or complementarily thereto, the carrier pad may be adhesively bonded in the carrier-pad receptacle and/or be welded therein, in particular by an ultrasonic welding method. In this way the carrier pad may be reliably fastened to the brush.

In the device for manufacturing bristle arrangements for brushes, in particular toothbrushes, mentioned at the outset the object is achieved by one or more features of the invention, and in particular in that for dissipating electrostatic charges adhering to bristle filaments and/or bristle bundles which are to be conveyed, the conveying device is electrically grounded.

In order for the to be in-fed to the conveying device with the aid of the at least one removal device by way of which individual bristle bundles can be removed from the bristle reserve, it may be expedient for the conveying device to have at least one bundle-receiving device on which the material-box-side ends of the hollow conduits are connected. Advantageously, the at least one bundle-receiving device and/or the hollow conduits here are/is electrically grounded in order to dissipate electrostatic charges from the bristle filaments or the bristle-bundles to be conveyed, respectively, or to avoid electrostatic charging of the bristle filaments and/or bristle bundles to be conveyed, respectively, when being conveyed through the conveying device.

For effective dissipation of electrostatic charges it may be advantageous for the at least one bundle-receiving device and/or at least one of the hollow conduits to have at least one electrically grounded terminal or ground terminal which are/is at least temporarily contacted by the bristle bundles and/or the bristle filaments contained in the bristle bundles when being conveyed through the bundle-receiving device and/or through the at least one hollow conduit. Here, in particular the bundle-receiving device and/or at least one of the hollow conduits and/or the terminal or ground terminal may be connected to the ground by way of at least one electrical conductor, in particular by way of an electrically grounded post of the device.

Moreover, in one embodiment of the device according to the invention it may be provided that at least one hollow conduit as an electrically grounded terminal or ground terminal has an electrically grounded inner sleeve face of an electrically conductive material, in particular of metal, preferably of steel, stainless steel, or copper, which is contacted by the bristle bundles and/or bristle filaments contained therein when being conveyed.

Advantageously, the hollow conduits here may be configured as tubes of a flexible material and/or as Bowden cable sleeves and/or as tubular connectors of an electrically conductive material, in particular of metal, preferably of steel, stainless steel, or of copper. However, this being particularly cost-effective and well suited to dissipating electrostatic charges, the use of hollow conduits which are in each case comprised of a Bowden cable sleeve is preferable.

Particularly efficient in-feeding of bristle bundles to a bundle-retaining plate which is held ready on the device is enabled when the conveying device has a number of hollow conduits corresponding to the number of perforations of the bundle-retaining plate.

It may be advantageous in particular with a view to carrying out the method described earlier for the bundle-retaining plate to be configured as a conveying plate which is transferable to a further-processing installation, in particular to a welding station. In another embodiment of the invention the bundle-retaining plate on a side which in the receiving position faces away from the conveying device may have at least one carrier-pad mounting for a carrier pad, in particular for a carrier pad as described earlier.

However, it should be pointed out that the bundle-retaining plate may also be a partial brush body or an injection-molding insert which after having been populated with bristle bundles may be further processed in downstream stations of the device.

In one refinement of the device according to the invention, which is of particular importance, it may be provided that the hollow conduits of the conveying device open out into in each case one guide duct of a guide element. This guide element may also be referred to as an in-feed block. The guide ducts of the guide element or of the in-feed block, respectively, here are in each case configured as through openings. It should be noted that the mutual outfeed-side spacings of the guide ducts are smaller here than the in-feed-side spacings. It may be particularly advantageous for the exit openings of the guide ducts to be disposed according to a disposal of perforations of the bundle-retaining plate which are to be populated with bristle bundles and/or to be disposed so as to open out into these perforations. In this way, populating the bundle-retaining plate may take place in a particularly efficient manner, after in-feeding of the bristle bundles through the conveying device has taken place.

The in-feed ducts of the guide element or of the guide block, respectively, thus function as a type of funnel by way of which the bristle bundles to be in-fed may be incorporated in the bundle-retaining plate so as to be brought closer to one another as they are being conveyed.

In order for the bristle bundles to be able to be incorporated with the desired degree of compression in perforations of a carrier pad which is held ready at the device, it may be expedient for the device to have a funnel plate having funnel ducts which in particular narrow in the conveying direction of the bristle bundles, which is disposable between the bundle-retaining plate and a carrier pad to be populated with bristle bundles. Through these funnel ducts the bristle bundles from the bundle-retaining plate, in which they are held ready in terms of disposal and orientation in a manner adapted to the carrier pad to be populated, may then be introduced into perforations of a carrier pad which is held ready at the funnel plate, preferably in a carrier-pad mounting of the funnel plate. It is advantageous here for entry openings of the funnel ducts to correspond in their number and disposal to exit openings of the perforations of the bundle-retaining plate and for exit openings of the funnel ducts to correspond in their number and disposal to the perforations of the carrier pad. It is furthermore advantageous for the exit openings of the funnel ducts to open out into perforations of a carrier pad which is held ready on the funnel plate, in order for the bristle bundles to be able to be incorporated from the bundle-retaining plate through the carrier plate into the carrier pad as easily as possible.

In order for the bristle bundles in-fed by the conveying device of the bundle-retaining plate to be able to be incorporated reliably and with the desired degree of compression through the funnel plate into the perforations of a carrier pad which is held ready at the funnel plate, the device may have a compression station having at least one compression die having compression fingers which in their number and disposal correspond to the perforations of the bundle-retaining plate and/or to the funnel ducts of the funnel plate and/or to the perforations of the carrier pad. With the aid of these compression fingers the bristle bundles which in particular are incorporated in the funnel plate and/or in the bundle-retaining plate may be incorporated into the perforations of the carrier pad which is held ready at the device, in particular at the funnel plate and/or at the bundle-retaining plate.

In this way the bristle filaments which are assembled to form bristle bundles can be in-fed having a slight degree of compression which is required for conveying through the conveying device by a gas or air stream and with the aid of the compression die according to the invention subsequently be incorporated mechanically into the perforations of the carrier pad which is held ready and here simultaneously be compressed to the required higher degree of compression. In particular in the case of relatively high degrees of compression, mechanical compression of the bristle bundles, toward which the funnel ducts of the funnel plate described earlier may also contribute, represents a particularly simple manner of compressing and incorporating the bristle bundle into the carrier pad being held ready.

It may be advantageous above all for carrying out the method according to the invention which has already been described earlier for the device to have a conveying gripper and a welding station. The conveying gripper here preferably may be configured as a turntable having at least one conveying receptacle for a funnel plate and/or bundle-retaining plate which are/is populated by bristle bundles and/or by at least one carrier pad. It should be pointed out that the bundle-retaining plate, which then additionally may assume the function of a conveying plate, by the conveying gripper after populating the bundle-retaining plate with bristle bundles and/or with at least one carrier pad is conveyable to a or to the welding station, wherein the bristle bundles in the welding station are connectable in particular in a form-fitting and/or force-fitting manner to the at least one carrier pad.

Furthermore, it is possible for also the at least one funnel plate to be able to be conveyed between stations of the device by the conveying gripper.

It may be advantageous when, for connecting the bristle bundles to the at least one carrier pad, the welding station has at least one welding die by way of which the bristle bundles are connectable to the at least one carrier pad. If the carrier pad to be processed is a carrier pad as has been described earlier, it is possible for the at least one welding die to be used for fusing the material protrusions of the carrier pad and for interference-fitting the fused material protrusions into a bundle-fastening plane of the respective carrier pad. Here the at least one welding die in the welding position may be in contact with a back side of the carrier pad.

In one embodiment of the invention, this at least one welding die may be heated to a temperature of about 500° C. in order to weld the bristle bundles to the respective carrier pads.

It should be pointed out again at this juncture that the use of a carrier pad as described earlier together with the device as described earlier may simplify the manufacture of bristle arrangements to a particular extent, in particular when the method which likewise has been described earlier is applied.

The advantages which may be derived from the device for manufacturing bristle arrangements according to the invention may be particularly great when the bristle filaments are chemically tapered filaments—CTFs—since these particularly fine bristle filaments may be subject to a particular extent to static charging when being conveyed by a gas or air stream through the conveying device, such that in-feeding of such chemically tapered bristle filaments to date has only been possible with disproportionate complexity.

It may be expedient for the device to have a de-sheathing station which is upstream of the material box, for de-sheathing bristle filaments which are assembled by a sheathing to form filament pucks. The de-sheathing station here may have at least one cutting device having at least one cutting tool for opening the sheathing of the filament pucks and at least one gripping installation for removing the opened sheathing. It may be furthermore advantageous for the de-sheathing station to be connected in terms of conveying technology to the material box downstream thereof, in order for the de-sheathed bristle filaments to be in-fed to the material box. For this purpose, the de-sheathing station in one embodiment of the device according to the invention has at least one gripper and/or at least one slide by way of which the de-sheathed bristle filaments are in-feedable to the material box, preferably in an automated manner.

In order for the bristle filaments to be able to be in-fed to the material box in an automated manner, the material box may have at least one conveying path which in particular is connected in terms of conveying technology to a de-sheathing station, for example the de-sheathing station which has already been mentioned earlier. In this at least one conveying path the bristle filaments which are oriented in the vertical direction may be disposed between two lateral strips, wherein the conveying path preferably opens out into a removal region of the removal installation.

In order for the introduction of the bristle filaments into the at least one conveying path to be facilitated, the at least one conveying path may have an insertion region in which the spacing of the lateral strips which delimit the at least one conveying path is reduced in the conveying direction.

Moreover, the device may have a transfer station having at least one suction gripper for transferring bristle filaments which are assembled by a sheathing to form filament pucks to a de-sheathing station, for example the de-sheathing station which has already been mentioned earlier. In this way, automated in-feeding of the filament pucks to the de-sheathing station is possible.

Here a suction gripper, for example the suction gripper already mentioned earlier, of a transfer station, for example the transfer station already mentioned earlier, may have a suction plate which preferably is covered by a fabric, in particular by a galloon fabric, and by way of said suction plate at least one filament puck across its sheathless end side which faces away from a contact area is acquirable by suction.

Acquiring the at least one filament puck by suction and subsequently handling the at least one filament puck with the aid of the at least one suction gripper of the transfer station may be facilitated when a sheathing keeping together a filament puck in the use position on the longitudinal side radially surrounds the bristle filaments which are assembled in the filament puck, such that an end-side upper side of the filament puck is sheathless.

Expediently, the sheathing here may be configured as an endless tape, that is to say as banderole, or as a tubular portion which is placed over the bristle filaments which are assembled to form a puck or as a sleeve which is placed thereover. Advantageously, a height of the sheathing here may correspond to a length of the bristle filaments of the filament puck.

Acquiring the filament pucks which are surrounded by the sheathing by suction with the aid of a suction gripper, for example the suction gripper already mentioned earlier, may be facilitated when the sheathing of the filament pucks is comprised of a flexible and/or air-impermeable material. One material which is suitable as sheathing and which is both flexible and air-impermeable is for example polyethylene, preferably PE-LD.

Furthermore, the device may have an in-feed station which is connected to a transfer station, for example the transfer station already mentioned earlier, and which has at least one contact area which in particular is configured as a conveyor belt. On this at least one contact area the filament pucks may be in-feedable to the transfer station and/or to the at least one suction gripper of the transfer station. In order for the individual filament pucks to be able to be reliably removed from the contact area, for example with the aid of the suction gripper, it may be expedient for the filament pucks on the at least one contact area which is preferably configured as a conveyor belt to be kept so as to be spaced apart. In order for the filament pucks on the contact area to be kept so as to be spaced apart, said contact area may preferably have a plurality of receptacle depressions which in particular in the conveying direction are spaced apart from one another and into which the individual filament pucks are placed and in which the filament pucks may be securely conveyed onward.

If the in-feed station on at least one of its longitudinal sides, in particular on one of the longitudinal sides of the at least one contact area, has at least one locationally fixed depository face, which adjoins the at least one contact area, for individually pre-aligned filament pucks and/or for supply containers which are at least partially filled with filament pucks, it is possible for the contact area, in particular receptacle depressions of the contact area which on the contact area are disposed and configured so as to be spaced apart from one another, to be rapidly and efficiently populated with filament pucks, if and when required. To this end, the filament pucks may either be removed from the adjoining depository face or directly put onto the contact area from supply containers which are held ready and which likewise may be held ready on the adjoining depository face, as soon as space becomes available again on said contact area for filament pucks which are to be in-fed to the transfer station and/or to the at least one suction gripper of the transfer station.

It should be pointed out that the depository face here may be configured in particular in a board-shaped and/or strip-shaped manner and may expediently extend at least across part of the length of the contact area, but is locationally fixed in relation to the contact area.

It goes without saying that the device according to the invention may also have more than only one bundle-retaining plate and/or funnel plate. In the case of a device which has, for example, four bundle-retaining plates and four funnel plates which are assigned to those bundle-retaining plates and which preferably may be disposed on conveyor receptacles of a conveying gripper or of the conveying gripper already mentioned earlier, said device may operate to a particularly efficient degree.

Furthermore, each of the thus at least one bundle-retaining plate and/or of the at least one funnel plate of the device may have at least one, in particular two, three, or four carrier-pad mounting(s) for receiving in each case one carrier pad to be populated with bristle bundles.

BRIEF DESCRIPTION OF THE DRAWINGS

An exemplary embodiment of the invention is explained in more detail herebelow by the drawings in which, partially in a heavily schematic manner.

DETAILED DESCRIPTION OF THE PREFERRED EMBODIMENTS

Figure 1:
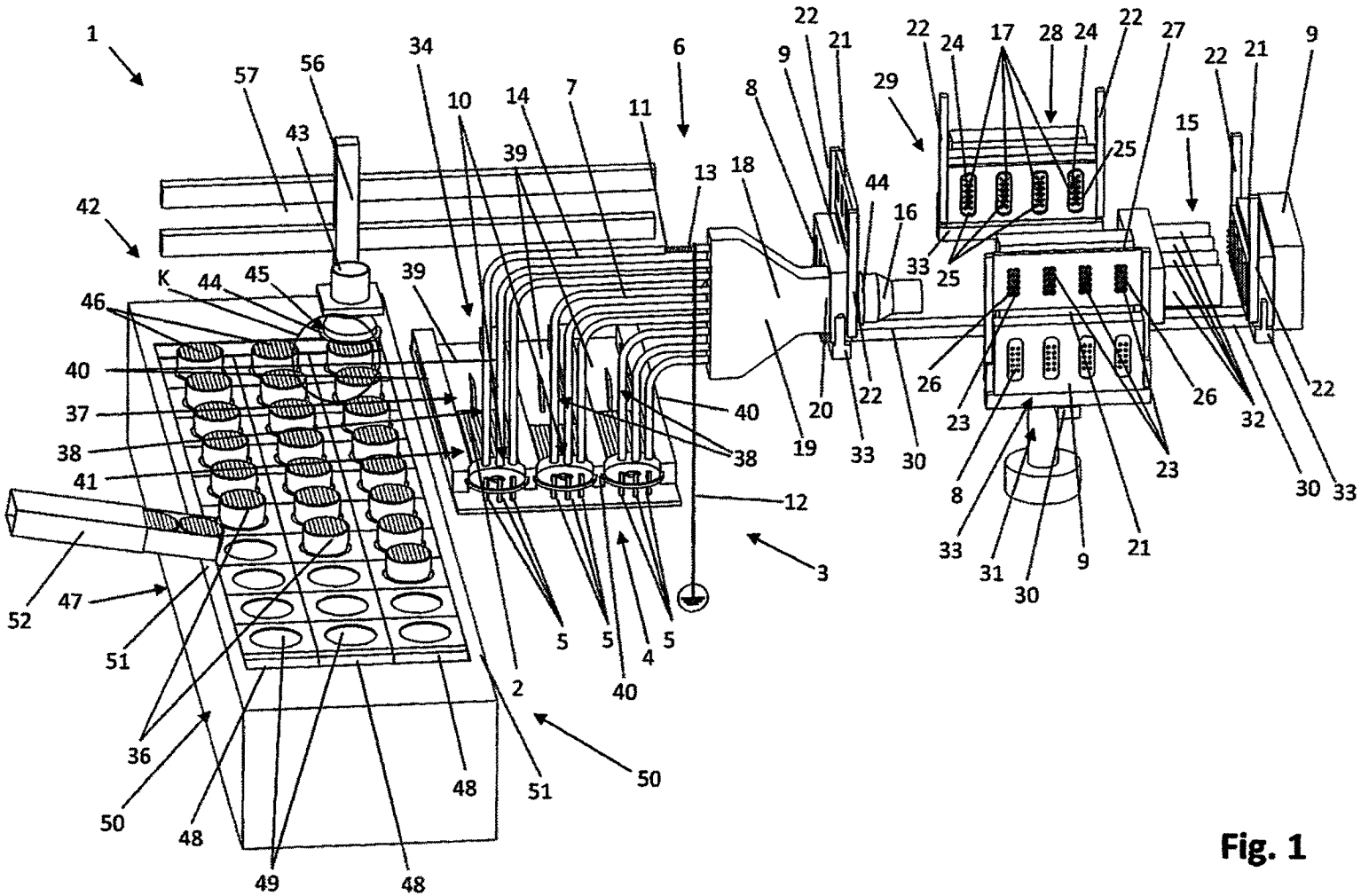
FIG. 1 shows a perspective illustration of a device according to the invention for manufacturing bristle arrangements for brushes, in particular toothbrushes, having an in-feed station comprising three parallel conveyor belts having a plurality of filament pucks placed thereon, having a transfer station with a suction gripper, having a de-sheathing station adjoining a material box, having a conveying device which has a plurality of hollow conduits through which the bristle bundles which are removed from the material box are conveyable to a bundle-retaining plate, and having processing stations which are downstream of the conveying device and which by way of a conveying gripper which is configured as a turntable are connected to the conveying device.

A device, which in its entity is referred to with 1, for manufacturing bristle arrangements for brushes, in particular for toothbrushes, according to FIG. 1 has a material box 3 having a reserve of bristle filaments 2, and at least one removal device 4 for removing individual bristle bundles 5 from the material box 3.

According to FIG. 1 the device 1 furthermore has a conveying device 6 which is equipped with a total of three times three visible hollow conduits 7 and one hollow conduit which in FIG. 1 is illustrated so as to be concealed, that is to say with a total of ten hollow conduits 7, by way of which hollow conduits 7 the bristle bundles 5 are conveyable by a gas or air stream into perforations 8 of a bundle-retaining plate 9.

In order to dissipate electrostatic charges which adhere to the bristle filaments 2 and/or bristle bundles 5 to be conveyed, the conveying device 6 is electrically grounded.

In one embodiment of the device 1 which is not illustrated in the figures, the conveying device 6 has at least one bundle-receiving device which is connected to the material-box-side ends 10 of the hollow conduits 7, wherein the at least one bundle-receiving device in this exemplary embodiment of the device 1 is electrically grounded.

In the exemplary embodiment of the device 1 illustrated in FIG. 1 the material-box-side ends 10 of the hollow conduits 7 terminate above the removal device 4 of the material box 3. There is no bundle-receiving device provided in this exemplary embodiment of the device 1.

As can be further seen from FIG. 1, the hollow conduits 7 of the conveying device 6 are electrically grounded.

In order to be electrically grounded, the hollow conduits 7 have at least one electric terminal or ground terminal 11 which is least temporarily contacted by the bristle bundles 5 and/or the bristle filaments 2 contained in the bristle bundles 5 when being conveyed through the hollow conduits 7, wherein in particular the hollow conduits 7 and the ground terminals 11 which are assigned to the hollow conduits 7 are grounded or connected to the ground, respectively, by way of an electric conductor 12.

In one exemplary embodiment of the device 1 which is not illustrated in the figures, this at least one electric conductor 12 is connected to the ground by way of an electrically grounded post of the device 1.

FIG. 1 shows that at least one of the hollow conduits 7 as an electrically grounded terminal or ground terminal 11 has an electrically grounded inner sleeve face of an electrically conductive material, in particular of metal, preferably of steel, stainless steel, or copper, which is contacted by the bristle bundles 5 and/or bristle filaments 2 contained therein when being conveyed. This electrically grounded inner sleeve face in the exemplary embodiment of the device 1 illustrated in FIG. 1 is comprised of a metal helix 13 which in the topmost of the hollow conduits 7 illustrated in FIG. 1 is illustrated as having been freed of its plastic sheathing.

While the hollow conduits 7 in other exemplary embodiments are configured as tubes of a flexible material or else as tubular connectors of an electrically conductive material, in particular of metal, preferably of steel, stainless steel, or of copper, the hollow conduits 7 in the exemplary embodiment of the device 1 illustrated in FIG. 1 are compissed of Bowden cable sleeves 14 which in their interior have the already mentioned electrically conductive metal helix 13 as the ground terminal 11.

When being conveyed through the hollow conduits 7, the bristle filaments 2 or the bristle bundles 5, respectively, then contact this electrically conductive metal helix 13 of the Bowden cable sleeves 14, such that electric charges which adhere to the bristle filaments 2 or to the bristle bundles 5 may be reliably dissipated.

The number of hollow conduits 7 in the conveying device 6 illustrated in FIG. 1 corresponds to the number of perforations 8 of the bundle-retaining plate 9 into which the bristle bundles 5 are to be incorporated. Moreover, the bundle-retaining plate 9 is configured as a conveying plate which is transferable to a further processing installation, in particular to the welding station 15. This bundle-retaining plate 9 thus assumes a double function.

In one exemplary embodiment of the device 1 not illustrated in the figures, the bundle-retaining plate 9 on a side which in the receiving position faces away from the conveying device 6 is equipped with at least one carrier-pad mounting for a carrier pad 17, such that at least one carrier pad 17 may be held ready on the bundle-retaining plate 9 in order to be filled with bristle bundles 5.

The hollow conduits 7 of the conveying device 6 open in each case into one guide duct 18 of a guide element 19, which may also be referred to as an in-feed block. These guide ducts 18 are in each case configured as through openings, wherein the mutual outfeed-side spacings of the guide ducts 18 are smaller than the in-feed-side spacings.

Furthermore, the exit openings 20 of the guide ducts 18 are disposed so as to correspond to a disposal of perforations 8 of the bundle-retaining plate 9 which are to be populated with bristle bundles 5 and so as to open into these perforations 8.

Furthermore, FIG. 1 shows that the device 1 has a total of four bundle-retaining plates 9. Moreover, each of the in total four bundle-retaining plates 9 is assigned one funnel plate 21. This funnel plate 21 is in each case disposable between the bundle-retaining plate 9 assigned thereto and at least one carrier pad 17 which is to be populated with bristle bundles 5.

For this purpose, each of the funnel plates 21 is displaceable to and fro in the vertical direction between two linear guides 22, in order for the funnel plates 21 to be disposed if and when required in the desired position between the respective bundle-retaining plate 9 and the at least one carrier pad 17 which is to be populated with bristle bundles 5.

Each of the funnel plates 21 has funnel ducts 23 which narrow in the conveying direction of the bristle bundles 5 and through which funnel ducts 23 bristle bundles 5 from the respective bundle-retaining plate 9 are introducible into perforations 24 of a carrier pad 17 which is held ready on the carrier plate 21 in each case in a carrier pad mounting 25 of the funnel plate 21. Here, entry openings 26 of the funnel ducts 23 correspond in their number and disposal to exit openings of the perforations 8 of the bundle-retaining plate 9, while exit openings 27 of the funnel ducts 23 correspond in their number and disposal to the perforations 24 of the at least one carrier pad 10 and open into these perforations 24 of the carrier pads 17 which are held ready on the funnel plate 21.

FIG. 1 shows that in each case four carrier pad mountings 25 for receiving carrier pads 17 are configured on each of the in total four funnel plates 21.

The device 1 has in each case one compression die 24 for each of the carrier pads 16 which is held ready on the respective bundle-retaining plate 9 or on the respective funnel plate 21, respectively. The in total four compression dies 28 here are disposed in the compression station which in FIG. 1 is identified with 29, and provided with compression fingers (not shown in the figures) which in their number and disposal conform to the perforations 8 of the bundle-retaining plate 9 and to the funnel ducts 23 of the funnel plate 21 and to the perforations 24 of the carrier pad 17.

By way of these compression fingers, bristle bundles 5 which are incorporated in the bundle-retaining plate 9 or in the funnel plates 21, respectively, may be reliably and with a desired degree of compression incorporated into perforations 24 of the carrier pads 17 which are held ready on the device 1, in the present case on the funnel plate 21.

The in total four bundle-retaining plates 9 and the likewise four funnel plates 21 assigned thereto are arranged on four arms 30 of a conveying gripper 31 which are mounted so as to be pivotable about a common axis, said conveying gripper 31 being configured as a turntable.

Furthermore, the device 1 has a welding station 15 to which the bundle-retaining plate 9 and the funnel plate 21 can be transferred by the conveying gripper 31. In each case one conveying receptacle 33 is configured on free ends of the arms 30 of the conveying gripper 31 for each of the four pairs comprised of in each case one bundle-retaining plate 9 and one funnel plate 21. The bristle bundles 5 may be connected in a form-fitting and/or force-fitting manner to the carrier pads 17 in the welding station 15.

A welding die 32 by way of which the bristle bundles 5 may be connected to the respective carrier pad 17 is provided in the welding station 15 for each of the carrier pads 16 which is disposed on the funnel plate 21 in the carrier pad mounting 25. The bristle filaments 2 which are processable using the device 1 are so-called chemically tapered filaments, that is to say CTFs, wherein also conventional bristle filaments may be processed on the device.

The device 1 has a de-sheathing station 34 which is upstream of the material box 3 and which serves for de-sheathing bristle filaments 2 which are held together in filament pucks 36 by a sheathing 35. The de-sheathing station 34 in the device illustrated in FIG. 1 here disposes of a total of three cutting device 37 which are in each case equipped with two cutting tools 38, presently with cutting blades, for opening the sheathing 35 of the filament pucks 36.

The filament pucks 36 illustrated in the figures are provided with a spin finish with an antistatic additive for CTFs, which may reduce the tendency of the bristle filaments 2 toward static charging when being conveyed.

In one exemplary embodiment of the device 1 (not illustrated in the figures), the de-sheathing station 34 furthermore has at least one gripping installation for removing the opened sheathings 35.

According to FIG. 1, the de-sheathing station 34 is connected in terms of conveying technology to the material box 3 which is downstream thereof. This material box 3 may have a gripper or a slide (not illustrated in the figures) by way of which the de-sheathed bristle filaments 2 are in-feedable to the material box 3, preferably in an automated manner.

The material box 3 illustrated in FIG. 1 has in total three conveying paths 39 which are connected in terms of conveying technology to the de-sheathing station 34 and in which the bristle filaments 2 which are oriented in the vertical direction are disposed between in each case two lateral strips 40.

It should be pointed out at this juncture that in the exemplary embodiment of the device 1 illustrated in FIG. 1 the de-sheathing station 34 is integrated in the three conveying paths 39 of the material box 3 in a particularly advantageous way.

FIG. 1 shows that the three conveying paths 39 open into a removal region 41 of the in total three removal devices 4. Furthermore, the conveying paths 39 in each case may have one introduction region (not illustrated in the figures) in which the spacing of the lateral strips 40 delimiting the respective conveying path 39 is reduced in the conveying direction of the filament pucks 36 or of the bristle filaments 2 which are freed of the respective sheathing 35, respectively.

Upstream of the de-sheathing station 34 the device 1 has a transfer station 42 having a suction gripper 43 for transferring bristle filaments 2 which are held together in filament pucks 36 by a sheathing 35 to the de-sheathing station 34.

According to FIG. 1 the suction gripper 43 is disposed on a mounting 56 which in turn is displaceably mounted on a rail system 57. By this mounting 56, the suction gripper 43 may then be displaced both in the horizontal and in the vertical direction, in order for individual filament pucks 36 to be transferred from the transfer station 42 to the de-sheathing station 34.

Figure 2:
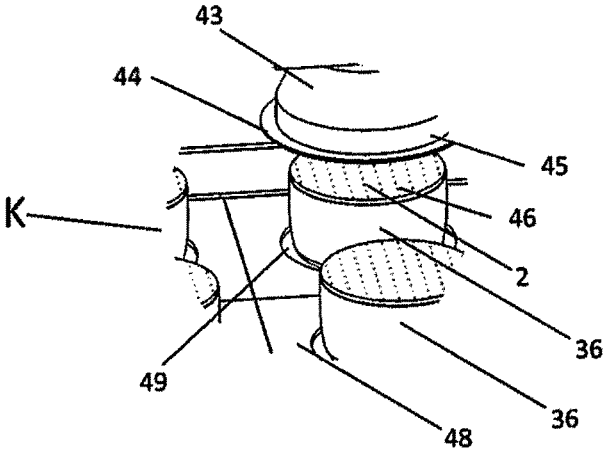
FIG. 2 shows the detail which in FIG. 1 is identified by the circle K and which shows the suction plate of the suction gripper, which is covered with a galloon fabric, in the suction position above a filament puck which is held ready on the contact area which is configured as a conveyor belt.

As can be seen in particular from the detail identified with K and illustrated in an enlarged manner in FIG. 2, the suction gripper 43 of the transfer station 42 has a suction plate 45 which is covered with a fabric which is impermeable to filaments, in the present case with a galloon fabric 44, by way of which suction plate 45 in each case at least one filament puck 36 by way of its upper side or end side 46 which faces away from a contact area is acquirable by suction.

The galloon fabric 44 with which the suction plate 45 of the suction gripper 43 is covered prevents the bristle filaments 2 being sucked out of the respective filament puck 36 which has been acquired by suction and said bristle filaments 2 being lost for further processing.

It should be pointed out at this juncture that the device 1 according to FIG. 1 has a suction unit 16 which is disposed beyond the bundle-retaining plate 9 which is held ready on the conveying device 6 and which generates the gas or air stream which is required for conveying the bristle bundle 5 through the hollow conduits 7 of the conveying device 6.

Like the suction gripper 43, the suction unit 16 is also covered with a fabric which is impermeable to filaments, in the present case with a galloon fabric 44, such that suctioning off bristle filaments 2 of individual bristle bundles 5 which have been sucked into the bundle-retaining plate 9 may be prevented.

From the detail which is illustrated in an enlarged manner in FIG. 2 and is identified with K in FIG. 1 it furthermore becomes obvious that the sheathing 35 which holds together a filament puck 36 and is also referred to as a puck sheath in the use position on the longitudinal side radially surrounds the bristle filaments 2 which are assembled in the respective filament puck 36, such that an end-side upper side 46 of the filament puck 36 is free of sheathing. The sheathing 35 or the puck sheath, respectively, thus is configured as an endless tape or as a tubular portion, respectively, or as a sleeve which laterally surrounds the respective filament puck 36. When observing the filament puck 36 illustrated in FIG. 1 it becomes obvious that a height of the respective sheathing 35 or of the puck sheath corresponds to about a length of the bristle filaments 2 of the filament puck 36.

The sheathing 35 or the puck sheath of the filament puck 36 here is comprised of a flexible and in the present case also air-impermeable material. The material of the sheathing 35 illustrated in FIGS. 1 and 2 is a polyethylene material which, on account of its properties is particularly suited to use as a puck sheath or sheathing 35.

Furthermore, the device 1 has an in-feed station 47 which is connected to the transfer station 42. This in-feed station 47 comprises three contact areas which are in each case configured as a conveyor belt 48, on which the filament pucks 36 may be in-fed to the transfer station 42 and to the suction gripper 43 which is assigned to the transfer station 42.

The filament pucks 36 are spaced apart on these three contact areas which are in each case configured as a conveyor belt 48.

For this purpose, all three contact areas which are configured as conveyor belts 48 have a plurality of receptacle depressions 49 which are spaced apart from one another in the conveying direction and which serve for in each case receiving one filament puck 36.

According to FIG. 1, the in-feed station 47 on at least one of its longitudinal sides 50 is equipped with at least one locationally fixed depository face 51 which adjoins the three contact areas which are configured as conveyor belts 48. Individual filament pucks 36 or supply containers 52 which are at least partially filled with filament pucks 36 may be held ready on this at least one locationally fixed depository face 51.

Due to this, it is possible for empty receptacle depressions 49 on the three contact faces which are configured as conveyor belts 48 to be swiftly populated with new filament pucks 36.

As will be seen from FIG. 1, the depository face 51 here is configured so as to be board-shaped or strip-shaped and extends across the entire length of the contact areas of the in-feed station 47 which are configured as conveyor belts 48.

Figure 3:
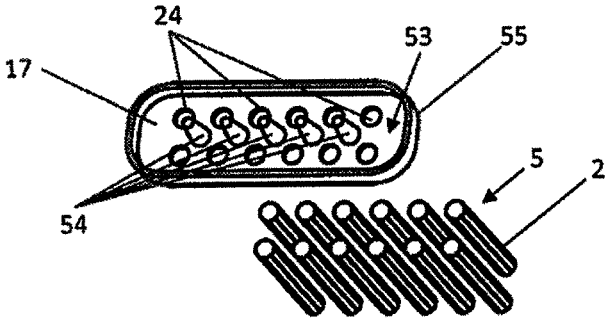
FIG. 3 shows a perspective rear view of a carrier pad, on the back side of which five material protrusions of a fusible material which are surrounded by perforations and on a front side of the carrier pad ten bristle bundles which are to be incorporated in the carrier pad can be identified.
Figure 4:
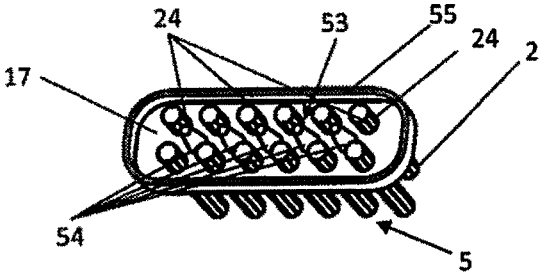
FIG. 4 shows the carrier pad illustrated in FIG. 3, having bristle bundles which have been introduced into the perforations of the carrier pad.
Figure 5:
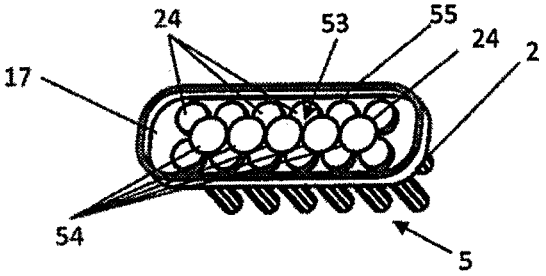
FIG. 5 shows the carrier pad illustrated in FIGS. 3 and 4, wherein it can be seen that the rear-side material protrusions have been fused and have been interference-fitted in the fastening plane of the carrier pad, in order to fasten the bristle bundles which have been incorporated into the perforations.

FIGS. 3 to 5 show an exemplary embodiment of a carrier pad 17. It should be pointed out at this juncture that the carrier pads 17 which in FIG. 1 have been processed using the device 1 are of the same type as the carrier pads 17 which are illustrated in FIGS. 3 to 5.

According to FIGS. 3 to 5, the carrier pad 17 has a plurality of perforations 24, here a total of ten, which penetrate the carrier pad 17 and in which the bristle bundles 5 comprised of bristle filaments 2 are insertable and are fastenable without anchoring on the carrier pad 17.

The carrier pad 17 on its back side 53 which faces away from the bristle bundles 5 which are introduced into the perforations 24 has a plurality of material protrusions 54, in total five. These material protrusions 54 are fusible and, for fastening the bristle bundles 5 on the carrier pad 17, are interference-fittable in a bundle-fastening plane.

While the bristle bundles 5 in the situation illustrated in FIG. 3 are still located in front of the carrier pads 17, in the situation illustrated in FIG. 4 they have already been introduced into the perforations 24 of the carrier pad 17. In the situation illustrated in FIG. 5, the material protrusions 54 have already be fused on the back side 53 of the carrier pad 17 and, for fastening the bristle bundle 5 on the carrier pad 17, have been interference-fitted in the bundle-fastening plane.

After fusing the material protrusions 54 and interference-fitting the fused material protrusions 54 in the bundle-fastening plane, the bristle bundles 5 are connected to the carrier pad 17 in a form-fitting and/or force-fitting manner.

According to FIGS. 3 and 4, the material protrusions 54 are configured as pimples, wherein the material protrusions 54 transversely project from the back side 53 of the carrier pad 10.

According to FIGS. 3 to 5, the material protrusions 54 are disposed so as to be uniformly distributed between the perforations 24 of the carrier pad 17.

In the exemplary embodiment of the carrier pad 17 illustrated in FIGS. 3 to 5, the perforations 24 of the carrier pad have a circular cross section.

However, it should be pointed out that it is also provided in embodiments of the carrier pad 17 that the perforations 24 have various cross sections, that is to say, for example, a round and/or oval and/or circular and/or polygonal cross section, or else are configured as elongate perforations in order for bristle arrangements with variously configured bristle bundles to be created.

FIGS. 3 to 5 show that the material protrusions 54 are integrally connected to the carrier pad 17, wherein the material protrusions 54 are comprised of the same material as the carrier pad 17, in particular of a fusible plastic material, preferably of a thermoplastic material. The material of which the bristle filaments 2 and/or the bristle bundles 5 are comprised here may have a lower melting point than the material from which the material protrusions 54 are manufactured. However, an embodiment in which the material of which the material protrusions 54 are comprised has a lower melting point than the material of which the bristle filaments 2 and/or the bristle bundles 5 are comprised, is preferable.

Moreover, FIGS. 3 to 5 clarify that the carrier pad 17 on its back side 53 which faces away from the bristle bundles 5 has an endless and closed delimitation 55 which perpendicularly projects from the back side 53 of the carrier pad 17 and which surrounds the perforations 24 and the material protrusions 54, and comprises the back side 53 of the carrier pad 17. The delimitation 55 of the carrier pad 17 here is at least half the height of the material protrusions 54 which are disposed on the back side 53 of the carrier pad 17.

In an exemplary embodiment of the carrier pad 17 illustrated in the figures, this limitation 55 is higher than the material protrusions 54 on the back side 53 of the carrier pad 17.

In the use position, the carrier pad 17 illustrated in FIGS. 3 to 5 may be fastened on or to, respectively, a brush, in particular on a toothbrush having a handle and a brush head which has a carrier-pad receptacle, for example by way of being clipped or adhesively bonded therein, or by being welded, in particular by an ultrasonic welding method, to the brush.

Following the description of the device 1 according to the invention and of the carrier pad 17 according to the invention, which may be processed on the device 1, there now follows a detailed description of the method according to the invention which is applied on the device 1 for manufacturing bristle arrangements for brushes, in particular for toothbrushes.

The bristle filaments 2 are removed from the material box 3 which contains a reserve of bristle filaments 2 and assembled to form bristle bundles 5. Thereafter, the bristle bundles 5 by a gas or air stream are guided through the hollow conduits 7 of the conveying device 6 and subsequently incorporated into the perforations 8 of the bundle-retaining plate 9.

According to FIG. 1, the device 1 has the suction unit 16 which is disposed beyond the bundle-retaining plate 9 which is held ready on the conveying device 6 and which generates the gas or air stream which is required for conveying the bristle bundles 5 through the hollow conduits 7 of the conveying device 6.

Like the suction gripper 43, the suction unit 16 is also covered with a fabric which is impermeable to filaments, in the present case with a galloon fabric 44, such that suctioning off bristle filaments 2 of individual bristle bundles 5 which have been sucked into the bundle-retaining plate 9 may be prevented.

In order to be able to avoid adhering of the bristle filaments 2 or of the bristle bundles 5, respectively, to elements of the conveying device 6 when being conveyed through the conveying device 6 to the bundle-retaining plate 9, the bristle filaments 2 forming the bristle bundles 5 are electrostatically discharged when being conveyed through the conveying device 6 to the bundle-retaining plate 9.

In this way it may be prevented that the bristle bundles 5 or the bristle filaments 2, respectively, on account of frictional forces acting thereupon when being conveyed through the conveying device 6, are statically charged and thus adhere to the elements of the conveying device 6.

When the device 1 illustrated in FIG. 1 is used, the bristle filaments 2 forming the bristle bundle 5 are electrostatically discharged when being conveyed through the hollow conduits 7 of the conveying device 6 to the bundle-retaining plate 9.

In order to be electrostatically discharged, the bristle filaments 2 forming the bristle bundles 5 when being conveyed through the conveying device 6, more specifically when being conveyed through the hollow conduits 7 of the conveying device 6, to the bundle-retaining plate 9 are grounded for electrostatic discharging.

Here, the bristle filaments 2 forming the bristle bundles 5, when being conveyed through the conveying device 6, for electrostatic discharging are guided past an electric terminal which is disposed on the conveying device 6 and which here is configured as a ground terminal 11 and are brought into contact with said electric terminal for electrostatic discharging. The ground terminal 11 which the bristle filaments 2 forming the bristle bundles 5 contact when being conveyed through the conveying device 6, in the device 1 illustrated in FIG. 1 is provided in the hollow conduits 7 and disposed therein.

In the device 1 illustrated in FIG. 1, the hollow conduits 7 are Bowden cable sleeves 14. In the topmost of the hollow conduits 7 illustrated in FIG. 1 part of an outer plastic sheathing of the hollow conduit 7 which is configured as a Bowden cable sleeve 14 has been removed, such that an inner metal helix 13 of the Bowden cable sleeve 14 is visible. This metal helix 13 functions as the ground terminal 11 by way of which the bristle bundles 5 which are conveyed through these hollow conduits 7 which are configured as Bowden cable sleeves 14 and the bristle filaments 2 forming the bristle bundles 5 are contacted and may thus be discharged.

The metal helix 13 illustrated in FIG. 1 is connected to the electric conductor 12 which is configured for dissipating electrostatic charges to the ground.

It should be pointed out at this juncture that all hollow conduits 7 of the device 1 which are illustrated in FIG. 1 are configured as Bowden cable sleeves 14 which in each case have one inner metal helix 13 as a ground terminal 11, which extends across the entire length of the individual hollow conduits 7. Each of the hollow conduits 7 illustrated in FIG. 1 is grounded by way of the electric conductor 12 or connected to the ground for dissipating electrostatic charges, respectively.

In one embodiment of the method according to the invention it is provided that the bristle bundles 5 from the bundle-retaining plate 9 are directly incorporated into perforations 24 of a carrier pad 17 which is held ready through narrowing funnel ducts 23 of the funnel plate 21.

In the method which is applied on the device 1 illustrated in FIG. 1 the bristle bundles 5 are introduced into the perforations 24 of the in total four carrier pads 17 which are held ready on the funnel plate 21 with the aid of the compression die 28 through the narrowing funnel ducts 23 on the funnel plate 21.

This takes place in the compression station which is referred to as 29 of the device 1 which is illustrated in FIG. 1.

Subsequently, the material protrusions 54 which project on the rear side of the back side 53 of the carrier pad 17 which faces away from the bristle bundles 5 are heated and thereby fused in the welding station 15, wherein a melt of the fused material protrusions 54 is interference-fitted in a fastening plane of the bristle bundle 5 for connecting the bristle bundles 5 to the respective carrier pad 17, such that the melt flows in between ends of bristle bundles which project from the back side 53 of the respective carrier pad 17 and in between ends of bristle filaments of the bristle bundles 5 and thereafter solidifies.

The material protrusions 54 on the carrier pad 17 here by the welding die 32 are heated, fused and interference-fitted in a fastening plane of the bristle bundle 5, in order for the bristle bundles 5 to be fastened on the carrier pad 17.

The bristle bundles 5 which are in-fed to the bundle-retaining plate 9 here are bristle bundles of chemically tapered bristle filaments 2, that is to say so-called CTFs.

The bristle filaments 2 are in-fed to the transfer station 42 in filament pucks 36 which are held together by a flexible and air-impermeable sheathing 35. The filament pucks 36 in-fed to the transfer station 42 are then acquired by suction by a suction gripper 43 which is assigned to the transfer station 42, wherein the suction gripper 43 by way of its suction plate 45 contacts and acquires by suction the filament pucks 36 on their free upper side or end side 46.

The peculiarity here is in that the flexible and air-permeable sheathing 35, which earlier has also already been referred to as a puck sheath, is acquired by suction in a transverse manner to the longitudinal axis of the bristle filaments 2 and in an inward manner in the direction of a longitudinal center axis which is perpendicularly oriented to the upper side 46 of the respective filament puck 36 and, on account thereof, places itself in a stabilizing manner around the bristle filaments 2 of the filament puck 36 which has been acquired by suction.

Once the suction gripper 43 has acquired by suction one of the filament pucks 36, the filament puck 36 is transferred to the de-sheathing station 34 by the suction gripper 43.

As already mentioned, the filament pucks 36 which in the figures are being in-fed to the transfer station 42 are provided with a spin finish with an antistatic additive for CTFs which reduces the tendency of the bristle filaments 2 toward static charging when being conveyed through the conveying device 6.

According to FIG. 1, the suction gripper 43 is disposed on a mounting 56 which in turn is displaceably mounted on a rail system 57. With the aid of this mounting 56 the suction gripper 43 may then be displaced both in the horizontal and in the vertical direction, in order for individual filament pucks 36 to be transferred from the transfer station 42 to the de-sheathing station 34.

In the de-sheathing station 34 the sheathing 35 of the filament pucks 36 is opened and removed, and the bristle filaments 2 which have been freed of the sheathing 35 are in-fed to the material box 3 in an automated manner.

Upstream of the transfer station 42 the device 1 has the in-feed station 47 by which the filament pucks 36 are in-fed to the transfer station 42 and the suction gripper 43 of the transfer station, in the present case on a total of three contact areas of the in-feed station 47 which are configured as conveyor belts 48.

The filament pucks 36 are individually held ready at the in-feed station 47 on the three contact areas which are configured as conveyor belts 48 or, as is illustrated in FIG. 1, are held ready in their supply containers 52 and, if and when required, are preferably manually pushed directly from the supply containers 52 onto the three contact areas which are configured as conveyor belts 48, in particular in a transverse manner to the conveying direction of the three conveyor belts 48.

The method for manufacturing bristle arrangements for brushes, and the device 1, the carrier pad 17, and the brush which is populated with a carrier pad 17 of this type, enable simplification of the manufacture of bristle arrangements for brushes, inter alia in that the bristle bundles 5 which by a gas or air stream are conveyed through the conveying device 6 to the bundle-retaining plate 9 when being conveyed through the conveying device 6 are electrostatically discharged, such that they may be more easily conveyed through the conveying device 6, and in that they reduce the complexity in the fastening of bristle bundles 5 in a carrier pad 17 without anchoring, since the carrier pad 17 on the rear side has material protrusions 54 which are fused and thereafter interference-fitted in a bundle-fastening plane, in order for bristle bundles 5 which have been incorporated into the perforations 24 of the carrier pad 17 to be connected in a form-fitting and/or force-fitting manner to the carrier pad 17 in a simple manner.

The invention claimed is:

1. A method for manufacturing bristle arrangements for brushes, comprising removing bristle filaments (2) from a material box (3) which contains a reserve of the bristle filaments (2), assembling the bristle filaments (2) to form bristle bundles (5), directing the bristle bundles (5) by a gas or air stream through a conveying device (6) comprising a bundle-receiving device and hollow conduits (7) which are connected thereto, and subsequently incorporating the bristle bundles (5) through perforations (8) into a bundle-retaining plate (9), and electrostatically discharging the bristle filaments (2) forming the bristle bundles (5) when being conveyed through the conveying device (6) to the bundle-retaining plate (9) by at least one of the bundle-receiving device or the hollow conduits (7) having at least one electrically grounded terminal or ground terminal (11) and at least temporarily contacting at least one of the bristle bundles (5) or the bristle filaments (2) contained in the bristle bundles (5) with the at least one electrical terminal or ground terminal (11) during conveying through the bundle-receiving device or through the hollow conduit (7), and at least one of the bundle-receiving device, the hollow conduits (7), or the terminal or ground terminal (11) are connected to the ground by way of at least one electrical conductor (12).

2. The method as claimed in claim 1, wherein the bristle filaments (2) forming the bristle bundles (5) are grounded for electrostatic discharging during conveying through the conveying device (6) to the bundle-retaining plate (9).

3. The method as claimed in claim 1, further comprising incorporating the bristle bundles (5) from the bundle-retaining plate (9), directly or with the aid of a compression die (28), through narrowing funnel ducts (23) of a funnel plate (21) into perforations (24) of a carrier pad (17), and heating and fusing material protrusions (54) which protrude on a rear side of a back side (53) of the carrier pad (17) which faces away from the bristle bundles (5) using a welding station (15), and for connecting the bristle bundles (5) to the carrier pad (17) interference fitting a melt of the fused material protrusions (54) into a fastening plane of the bristle bundles (5), such that the melt flows at least one of between bristle-bundle ends which protrude from the back side of the carrier pad (17) or between bristle-filament ends of the bristle bundles (5), and thereafter solidifies.

4. The method as claimed in claim 3, wherein the material protrusions (54) on the carrier pad (17) are heated and fused by a welding die (32), and for fastening the bristle bundles (5) to the carrier pad (17) are interference-fitted into a fastening plane of the bristle bundles (5).

5. The method as claimed in claim 1, wherein the bundle-retaining plate (9) is in-fed bristle bundles (5) of chemically tapered bristle filaments (2).

6. The method as claimed in claim 1, further comprising in-feeding the bristle filaments (2) to a transfer station (42) in filament pucks (36) which are held together by a sheathing (35), and using suction to acquire the filament pucks (36) which are in-fed to the transfer station (42) by at least one suction gripper (43) which is assigned to the transfer station (42), and the at least one suction gripper (43) contacts and acquires by suction the filament pucks (36) at a free upper side or end side (46) thereof by way of a suction plate (45), due to which the sheathing (35) is acquired by suction in a transverse manner to a longitudinal axis of the bristle filaments (2) and in an inward manner in a direction of a longitudinal center axis which is oriented so as to be perpendicular to an upper side (46) of the filament puck (36), and said sheathing (35) places itself in a stabilizing manner around the bristle filaments (2) of the filament puck (36) which has been acquired by suction, and the filament pucks (36) by the at least one suction gripper (43) are transferred to a de-sheathing station (34) in which the sheathing (35) of the filament pucks (36) is opened and removed, and wherein the bristle filaments (2) which have been released from the sheathing (35) are in-fed to the material box (3).

7. The method as claimed in claim 6, wherein the filament pucks (36) of the transfer station (42) are in-fed to the at least one suction gripper (43) of the transfer station (42) on at least one contact area of an in-feed station (47) which is configured as a conveyor belt (48).

8. The method as claimed in claim 7, wherein the filament pucks (36) are held ready at least one of individually or in a supply containers (52) at the in-feed station (47) at the at least one contact area configured as a conveyor belt (48), and when required, are pushed onto the at least one contact area (48) from the supply containers (52), in a transverse manner to a conveying direction of the at least one contact area (48).

9. A device (1) for manufacturing bristle arrangements for brushes, comprising a material box (3) containing a reserve of bristle filaments (2), at least one removal device for removing individual bristle bundles (5) from the bristle reserve of the material box (3), a conveying device (6) with hollow conduits (7), through said hollow conduits (7) the bristle bundles (5) are conveyable by a gas or air stream into perforations (8) of a bundle-retaining plate (9), and an electrical ground connected to the conveying device (6) that dissipates electrostatic charges adhering to the bristle filaments (2) or bristle bundles (5) which are conveyed, wherein the conveying device (6) has at least one bundle-receiving device on which material-box-side ends (10) of the hollow conduits (7) are connected, and at least one of the at least one bundle-receiving device or at least one of the hollow conduits (7) are electrically grounded, and at least one of the at least one bundle-receiving device or the at least one of the hollow conduits (7) have at least one electrically grounded terminal or ground terminal (11) which is at least temporarily contacted by at least one of the bristle bundles (5) or the bristle filaments (2) contained in the bristle bundles (5) when being conveyed through the bundle-receiving device or through the at least one hollow conduit (7), and at least one of the bundle-receiving device, the at least one of the hollow conduits (7), or the terminal or ground terminal (11) are connected to the ground by way of at least one electrical conductor (12).

10. The device (1) as claimed in claim 9, wherein the at least one hollow conduit (7) as an electrically grounded terminal or ground terminal (11) has an electrically grounded inner sleeve face of an electrically conductive material which is contacted by at least one of the bristle bundles (5) or bristle filaments (2) contained therein when being conveyed.

11. The device (1) as claimed in claim 10, wherein the hollow conduits (7) are configured as tubes of a flexible material, Bowden cable sleeves (14), or tubular connectors of an electrically conductive material.

12. The device as claimed in claim 9, wherein the bristle filaments (2) are chemically tapered filaments (CTFs).

13. The device as claimed in claim 9, further comprising a de-sheathing station (34) which is upstream of the material box (3), for de-sheathing bristle filaments (2) which are assembled by a sheathing (35) to form filament pucks (36), the de-sheathing station (34) has at least one cutting device (37) having at least one cutting tool (36) for opening the sheathing (35) and at least one gripping installation for removing the opened sheathing (35), and the de-sheathing station (34) is connected in terms of conveying technology to the material box (3) downstream thereof and has at least one gripper or at least one slide by way of which the de-sheathed bristle filaments (2) are in-feedable to the material box (3).

14. The device (1) as claimed in claim 13, wherein the material box (3) has at least one conveying path (39) which is connected in terms of conveying technology to the de-sheathing station (34) and in which the bristle filaments (2) which are oriented in a vertical direction are disposed between two lateral strips (40), the conveying path (39) opens out into a removal region of a removal installation (4) and the at least one conveying path (39) has an insertion region in which a spacing of lateral strips (40) which delimit the conveying path (39) is reduced in a conveying direction.

15. The device as claimed in claim 14, further comprising a transfer station (42) having at least one suction gripper (43) for transferring bristle filaments (2) which are assembled by a sheathing (35) to form filament pucks (36) to the de-sheathing station (34).

16. The device as claimed in claim 15, wherein the at least one suction gripper (43) of the transfer station (42) has a suction plate (45) which is covered by a fabric which is impermeable to bristle filaments, and by way of said suction plate (45) at least one filament puck (36) across a sheathless end side or upper side (46) thereof which faces away from a contact area (48) is acquirable by suction.

17. The device as claimed in claim 16, wherein a sheathing (35) keeping together the filament puck (36) in a use position on a longitudinal side radially surrounds the bristle filaments (2) which are assembled in the filament puck (36), such that an end-side upper side (46) of the filament puck (36) is sheathless and/or wherein the sheathing (35) is configured as an endless tape or as a tubular portion or as a sleeve and/or wherein a height of the sheathing (35) corresponds to a length of the bristle filaments (2) of the filament puck (36).

18. The device as claimed in claim 17, wherein the sheathing (35) of the filament pucks (36) is comprised of at least one of a flexible or air-impermeable material.

19. The device as claimed in claim 18, wherein the device (1) has an in-feed station (47) which is connected to the transfer station (42) and which has at least one contact area which is configured as a conveyor belt (48) on which the filament pucks (36) are in-feedable to the transfer station (42) and to the at least one suction gripper (43) of the transfer station (42), the filament pucks (36) on the at least one contact area are kept so as to be spaced apart and the at least one contact area (8) has a plurality of receptacle depressions (49) for receiving the filament pucks (36), which are spaced apart from one another.

20. The device as claimed in claim 19, wherein the in-feed station (47) on at least one of its longitudinal sides (50) has at least one locationally fixed depository face (51), which adjoins the at least one contact area (48), for individually pre-aligned filament pucks (36) or for supply containers (52) which are at least partially filled with filament pucks (36), and the depository face (51) is configured in a board or strip-shaped manner and extends at least across part of the length of the contact area (48).

21. A device (1) for manufacturing bristle arrangements for brushes, comprising a material box (3) containing a reserve of bristle filaments (2), at least one removal device for removing individual bristle bundles (5) from the bristle reserve of the material box (3), a conveying device (6) with hollow conduits (7), through said hollow conduits (7) the bristle bundles (5) are conveyable by a gas or air stream into perforations (8) of a bundle-retaining plate (9), and an electrical ground connected to the conveying device (6) that dissipates electrostatic charges adhering to the bristle filaments (2) or bristle bundles (5) which are conveyed, the bundle-retaining plate (9) is configured as a conveying plate which is transferable to a further-processing installation, and the bundle-retaining plate (9) on a side which in the receiving position faces away from the conveying device (6) has at least one carrier-pad mounting for a carrier pad (17), the hollow conduits (7) of the conveying device (6) open out into in each case one guide duct (18) of a guide element (19), the guide ducts (18) are in each case configured as through openings and a mutual outfeed-side spacings of the guide ducts (18) are smaller than in-feed-side spacings, and exit openings (20) of the guide ducts (18) are disposed according to a disposal of the perforations (8) of the bundle-retaining plate (9) which are to be populated with bristle bundles (5), and are disposed so as to open out into said perforations (8), and a funnel plate (21) having funnel ducts (23) which narrow in a conveying direction of the bristle bundles (5), and is disposable between the bundle-retaining plate (9) and the carrier pad (17) to be populated with the bristle bundles (5), the funnel ducts (23) introducing the bristle bundles (5) from the bundle-retaining plate (9) into perforations (24) of the carrier pad (17) which is held ready at the funnel plate (21), and entry openings (26) of the funnel ducts (23) correspond in number and disposal to exit openings of the perforations (8) of the bundle-retaining plate (9), and exit openings (27) of the funnel ducts (23) correspond in number and disposal to the perforations (24) of the carrier pad (17) and open out into the perforations (24) of a carrier pad (17) which is held ready on the funnel plate (21).

22. A device (1) for manufacturing bristle arrangements for brushes, comprising a material box (3) containing a reserve of bristle filaments (2), at least one removal device for removing individual bristle bundles (5) from the bristle reserve of the material box (3), a conveying device (6) with hollow conduits (7), through said hollow conduits (7) the bristle bundles (5) are conveyable by a gas or air stream into perforations (8) of a bundle-retaining plate (9), and an electrical ground connected to the conveying device (6) that dissipates electrostatic charges adhering to the bristle filaments (2) or bristle bundles (5) which are conveyed, and a compression station (29) having at least one compression die (28) having compression fingers which in their number and disposal correspond to at least one of the perforations (8) of the bundle-retaining plate (8), the funnel ducts (23) of the funnel plate (21), or the perforations (24) of the carrier pad (17), by way of said compression fingers the bristle bundles (5) which in particular are incorporated in at least one of the funnel plate (21) or in the bundle-retaining plate (9) are incorporable into perforations (24) of a carrier pad (17) which is held ready at the device (1).

23. A device (1) for manufacturing bristle arrangements for brushes, comprising a material box (3) containing a reserve of bristle filaments (2), at least one removal device for removing individual bristle bundles (5) from the bristle reserve of the material box (3), a conveying device (6) with hollow conduits (7), through said hollow conduits (7) the bristle bundles (5) are conveyable by a gas or air stream into perforations (8) of a bundle-retaining plate (9), and an electrical ground connected to the conveying device (6) that dissipates electrostatic charges adhering to the bristle filaments (2) or bristle bundles (5) which are conveyed, and a conveying gripper (31) and a welding station (15), the conveying gripper (31) is configured as a turntable having at least one conveying receptacle (33) for at least one of a funnel plate (21) or the bundle-retaining plate (9) which is populated by the bristle bundles (5), or by at least one carrier pad (17), and the at least one of the bundle-retaining plate (9) or the funnel plate (21) by the conveying gripper (31) after populating the bundle-retaining plate (9) with bristle bundles (5) or with at least one carrier pad (17) is conveyable to the welding station (15), wherein the bristle bundles (5) in the welding station (15) are connectable to the at least one carrier pad (17).

24. The device as claimed in claim 23, further comprising a welding station (15) for connecting the bristle bundles (5) to the at least one carrier pad (17), the welding station (15) has at least one welding die (32) by which the bristle bundles (5) are connectable to the at least one carrier pad (17).

* * * * *